United States Patent [19]

Evans

[11] 3,958,851

[45] May 25, 1976

[54] SHIELDED CONNECTOR

[75] Inventor: Robert T. Evans, Poughkeepsie, N.Y.

[73] Assignee: IBM Corporation, Armonk, N.Y.

[22] Filed: Dec. 30, 1974

[21] Appl. No.: 537,231

[52] U.S. Cl. ..... 339/47 R; 339/143 R; 339/177 E

[51] Int. Cl.[2] ..... H01R 17/08

[58] Field of Search ..... 339/143, 177, 47–49; 174/35 C, 75 C

[56] References Cited

UNITED STATES PATENTS

| | | | |
|---|---|---|---|
| 3,235,834 | 2/1966 | O'Keefe et al. | 339/177 R |
| 3,363,221 | 1/1968 | Stark | 339/177 E |
| 3,430,183 | 2/1969 | Feeser et al. | 339/143 R |
| 3,670,293 | 6/1972 | Garver | 339/143 R |
| 3,757,276 | 9/1973 | Kailus | 339/143 R |
| 3,871,735 | 3/1975 | Herrmann, Jr. | 339/177 R |

OTHER PUBLICATIONS

IBM Technical Disclosure Bulletin, Evans, Vol. 16, No. 5, pp. 1505–1506, Oct. 1973.

*Primary Examiner*—Roy Lake
*Assistant Examiner*—Neil Abrams
*Attorney, Agent, or Firm*—Harold H. Sweeney, Jr.

[57] ABSTRACT

A connector for providing improved shielding of connections made in coaxial type wire is provided having a contact connected to the signal conductor of the coaxial wire located within a one piece insulator housing which completely surrounds the contact. An electrically conductive metallic coating is located on the entire outer surface of the insulator housing. The shield of the coaxial wire is connected to the electrically conductive metallic coating. A further metallic shield is folded around the metallic coated one piece insulator so as to provide a low resistance electrical path therebetween.

7 Claims, 7 Drawing Figures

SHIELDED CONNECTOR

BRIEF STATEMENT OF THE INVENTION

This invention relates to a connector for coaxial wire and more particularly, to a connector providing an improved shielding of the center conductor.

FIELD OF THE INVENTION

Today's pressures toward miniaturization, higher speed, higher density, higher performance, and low cost have required a constant redesign of connectors to remain compatible with the equipment they are interconnecting. Electrically, interconnections are transmission lines connecting one circuit to another, and therefore they incorporate all the signal transmission problems facing the communications engineer, such as impedance mismatch, crosstalk noise, energy loss, time delay, etc. In the data processing art there has been a continual decrease in signal rise time and circuit noise tolerance making these interconnections very sensitive.

It is known that cabling between electronic units, such as data processing units, is subjected to considerable electromagnetic energy which is converted into currents which can be conducted into the data processing machine causing errors. Shielding the cables and draining the noise signals into a good drain or "sink" proved to be somewhat effective. However, with the decrease in signal rise times, the higher speeds and greater densities introduced into the electronic equipment, electro-magnetic compatibility characteristics became more stringent. EMC (Electro-magnetic Compatibility) is an all inclusive technical term used to describe the ability of data processing equipment to function in it's intended operational environment without suffering or causing unacceptable performance degradation because of electro-magnetic susceptibility or interference. The connectors themselves connecting the signal conductors to the electronic equipment have been found to generate electro-magnetic energy as well as being susceptible to such energy. Referring to the IBM Technical Disclosure Bulletin of October 1973, pages 1505 and 1506, there is shown a connector utilized to terminate coaxial conductors, in which the shielding of the connector is provided by a metallic member having a number of discontinuities therein where various tabs and locking members are located. These discontinuities allow electro-magnetic radiation but more importantly expose the connector to environmental electro-magnetic energy. These discontinuities also interfere with the impedance matching characteristics of the connector.

It is an object of the present invention to provide a connector having improved shielding characteristics.

It is a further object of the present invention to provide an improved connector for coaxial conductors providing improved EMC characteristics using relatively inexpensive processes thereby providing a small, low cost connector.

It is a further object of the present invention to provide a connector in which the complete 360° shielding is provided by a combination of components which combination also provides for a strain relief.

SUMMARY OF THE INVENTION

A connector having improved shielding and utilized with coaxial type conductors is provided. A contact is connected to the signal conductor of the coaxial wire and is located within a one piece insulator housing which surrounds the contact and which has an electrically conductive metallic coating located thereon covering the entire outer surface of the insulator housing. The shield of the coaxial wire is connected to the electrically conductive metallic coating. A further metallic shield is folded around the metallic coated one piece insulator so as to provide an intimate parallel low resistance electrical path therebetween.

The foregoing and other objects, features and advantages of the invention will be apparent from the following more particular description of a preferred embodiment of the invention as illustrated in the accompanying drawings.

DESCRIPTION OF THE PREFERRED EMBODIMENT

Figure 1:
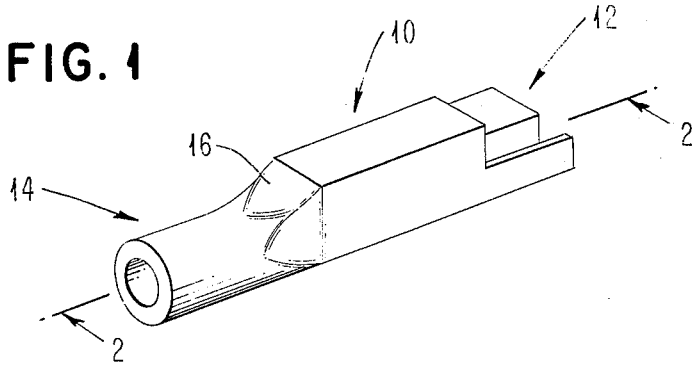
FIG. 1 is a perspective view of the one piece plastic insulator having an electrical conductive metallic coating thereon.

Referring to FIG. 1, there is shown a one piece molded plastic insulator member 10. The front end 12 of the insulator member is adapted to mate with an identical insulator member when that member is reversed. Thus, the end 12 of the insulator member 10 is formed to be hermaphroditic. The other end, end 14 of the insulator member 10 constitutes an elongated tubular extension of the main body of the insulator member. The entire outer surface of the insulator member 10 is coated with a conductive metallic coating 16. The metallic coating can be, for the purposes of this invention, any good conductive material such as silver, gold, etc. It has been found that alluminum is the preferrable material from a cost viewpoint. Vacuum deposition of the metallic coating provides a uniform thin coating which provides the desired shielding characteristics. The ultra-thin film vacuum deposition of metals is well known in the arts and has been used extensively for applying ultra-thin films for decorative purposes such as on lamps and toys. The coating should be no less than 0.000050 inches so that the shielding effect operates at it's maximum efficiency. It is important that the coating be over the entire outer surface and be somewhat uniform. The inner portions of the insulator member 10 were masked during the vacuum deposition process to prevent any of the conductive metal being deposited therein. It should be appreciated that when the insulator member 10 is mated with a similarly coated insulator member, the metallic coated surfaces contact each other such that the mated insulator members provide a continuity of the metallic coating and consequently a continuity of the shielding effect.

Figure 2:
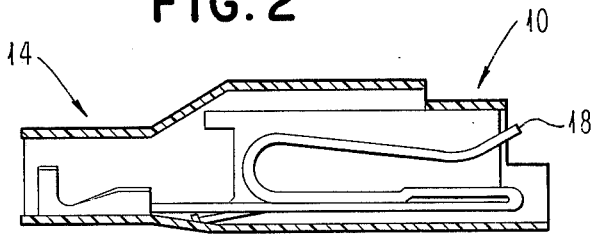
FIG. 2 is a cross-sectional view taken along the line 2—2 of FIG. 1 showing an electrical contact located within the one piece insulator.
Figure 7:
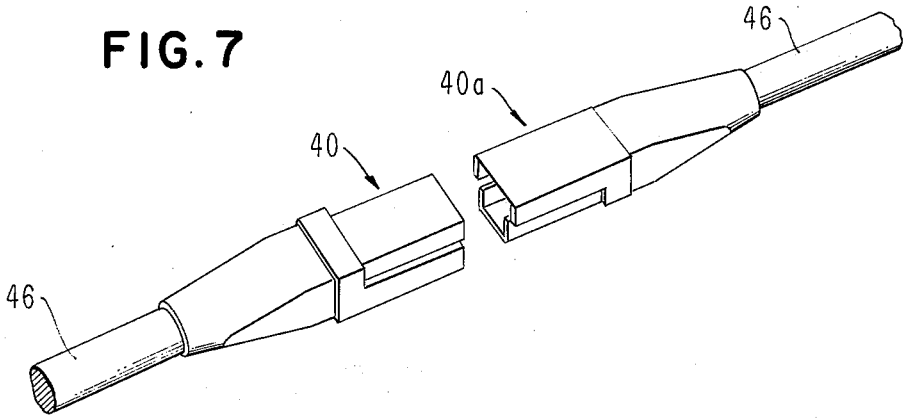
FIG. 7 is a perspective view of the outer housing which is utilized to surround the connector.

FIG. 2 is a cross-sectional view of the insulator member 10 better illustrating the metallic coating on the entire outer surface thereof. As can be seen, an electrical contact 18 is located within the conductor element 10. The contact element 18 shown in FIG. 2 is what is popularly termed a serpentine contact and is set forth in detail in U.S. Pat. No. 3,208,030 issued Sept. 21, 1965. This patent shows in detail the various parts of the contact itself as well as the details of the inside of the block or insulator which holds the contact in place. These same inside features are incorporated into the insulator member 10. It should be appreciated, that the invention is not limited to the use of the serpentine contact, but is operable with any metallic contact. The elongated tubular end 14 of the insulator member 10 must have a sufficient inside opening to allow the insertion therethrough of the contact element 18. The contact element 18 is attached to the center conductor of the coaxial wire which is to be connected therethrough. A further element of the combination is a further shield member 20 shown in open form in FIG. 3 and wrapped around the insulator member 10 in FIG. 4. This outer shield member 20 is made of a good conductive mechanically strong metal, such as phosphor bronze. This further shield member 20 may be stamped from sheet stock or may be formed using an etching process. As can be seen from FIG. 3, the resulting blank is adapted to be folded about the insulator member 10. This outer shield member 20 has a positive latch mechanism 26 on either side thereof and a stop tab 25. Also, wing members 24 extend from the sides of the external shield 20 to locate and support the contact assembly within a polarized housing or shroud, as shown in FIG. 7. A spring member 28 protrudes from the bottom of the outer shield member 20 to lock the member in place when in the correct position within the shroud 40. The outer shield member 20 has a forward extending beam member 42 which contacts the outer shield member 20 on the other hermaphroditic connector half that is to be connected thereto as shown in FIG. 5. As can be seen from FIG. 5, these beams 42 or forward extending fingers apply pressure on the other connector half which tend to keep the mated metallized insulators in mating contact. It should be noted that the beams also provide a connection across the interconnection gap when the connector halves are mated.

Figure 3:
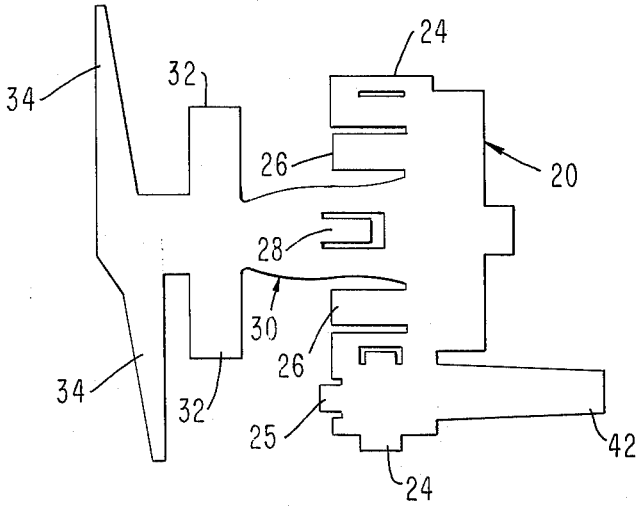
FIG. 3 is a plan view of the further metallic shield before it is wrapped around the metallic coated insulator member.
Figure 4:
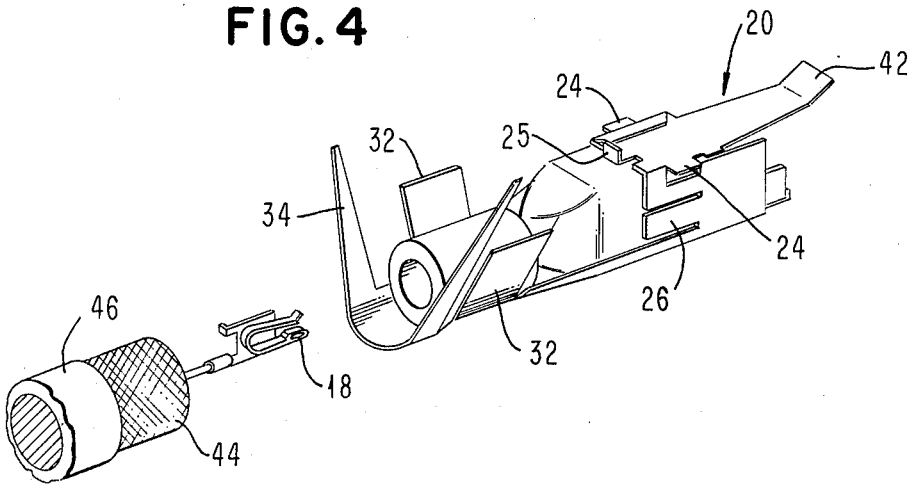
FIG. 4 is a perspective view showing the further metallic shield folded around the one piece metallic coated insulator with the contact about to be inserted therein.
Figure 5:
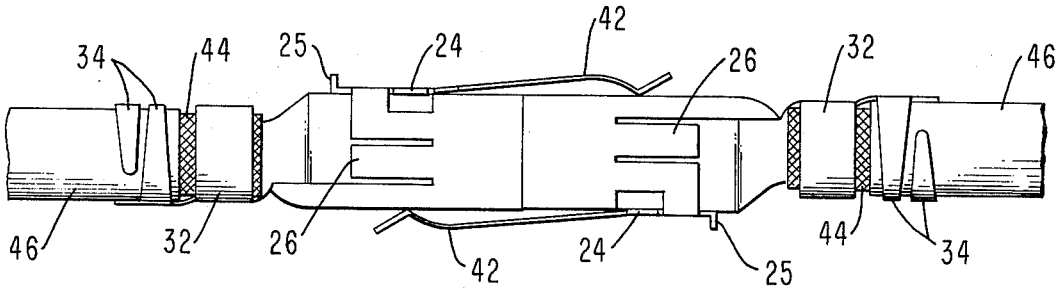
FIG. 5 is a perspective view showing the connector connected to an identical connector and having the conductive shield or braid of the coaxial wire mounted on the one piece insulator.

The outer shield member 20 has a rearwardly extending member 30 which, as can be seen from FIGS. 3, 4 and 5, has a pair of laterally extending holding members 32 which can be wrapped around the shield braid of the coaxial wire in opposite directions after it is fitted onto the outside diameter of the tubular extension 14 of the insulator member 10. These holding members 32 are crimped around the braid. The tubular member affords an excellent base about which the crimping can take place. Also it should be noted, that the tubular member 14 is coated with the metallic coating 16 and thus the shield 44 of the cable 46 is tightly held on the metallic coating 16 so that the shielding is continuous from the shield 44 of the cable onto the insulator member 10. The extension 30 of the outer shield member 20 has a further pair of ears 34 which are adapted to wrap around the cable 46 thereby providing a good grip on the cable as well as providing a strain relief.

Referring to FIG. 5 there is shown a perspective diagram of the hermaphroditic connector halves connected together. The outer shields 20 abut each other and the metallic coating 16 on the insulator member 10 forms a continuous shield within the outer shield member 20. These two shields, the metallic coating 16 and the outer shield member 20, provide a complete 360° shielding of the inner contact members. The impedance matching of the coaxial wire being connected through the connector is improved since the inner metallic shield 16 fills up the voids and discontinuities in the outer shield member 20 so that the two act together as a single shield. This combination shielding arrangement of the metallic coating shield 16 and the outer shielding member 20 allows for impedance matching with smaller outer geometries and improves the EMC characteristics significantly. At a one nanosecond rise time of the signals there were no discontinuities observed between two connected transmission lines of 75 ohms. The prior art connector showed an 89 ohm impedance at this rise time.

Figure 6:
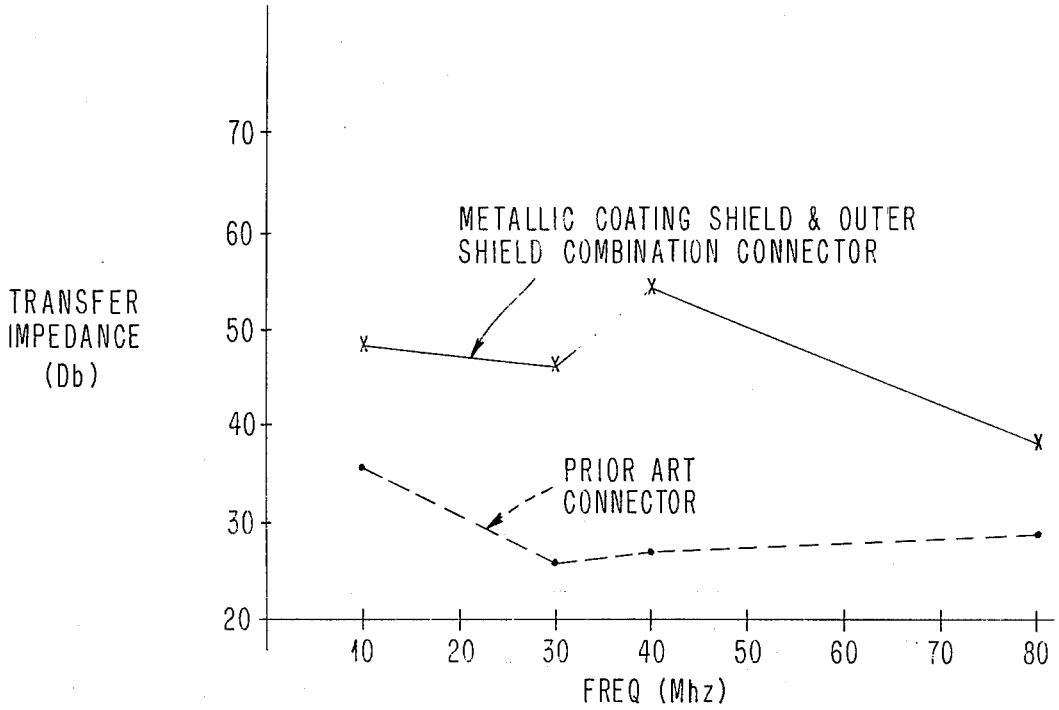
FIG. 6 is a graphical representation of the transfer impedance versus frequency for the improved connector and the prior art connector.

FIG. 6 shows a plot of the transfer impedance in decibels as the ordinate and the frequency in megahertz as the abscissa. The transfer impedance of a connector having the metallic coating shield 16 and outer shield member 20 combination was plotted at the various frequencies shown. Similarly, the prior art connector, that is the connector without the combination of metallic coating and outer shield combination, but having just the outer shield member surrounding a plastic holding member had the transfer impedance plotted at the same frequencies. It can be seen from the resulting plots, that approximately a 20DB improvement in shielding effectiveness in the mid-frequency range of 10 to 70 MHZ is obtained. This is equivalent to a 10:1 reduction in the noise levels reaching the center conductor signal line.

The shrouds 40 and **40*a* within which the connectors are included are shown in FIG. 7.** As can be seen, the shrouds as well as the connector halves are hermaphroditic and therefore fit together as illustrated. The shrouds can be enlarged to handle more than one connector therein. For example, a cable having a number of coaxial conductors therein can be brought into the shroud and the separate coaxial conductors terminated in connectors as illustrated above.

While the invention has been particularly shown and described with reference to a preferred embodiment thereof, it will be understood by those skilled in the art that various changes in form and detail may be made therein without departing from the spirit and scope of the invention.

I claim:

1. A connector for providing improved shielding of connections made in coaxial type wire comprising;

a contact connected to the signal conductor of a coaxial wire;

a one piece hermaphroditic insulator housing which completely surrounds said contact;

an electrically conductive thin metallic coating covering the entire outer surface of said insulator housing;

means for connecting the shield of the coaxial wire directly to said electrically conductive metallic coating;

a mechanically strong, one piece, electrically conductive shield element folded in intimate contact around said metallic coated one piece insulator so as to provide a low resistance electrical path therebetween;

means for connecting said electrically conductive shield element to the shield of the coaxial wire to form a mechanical and electrical connection therebetween;

further means for connecting said electrically conductive shield element to the outside of said coaxial wire forming a strain relief therewith;

means forming part of said mechanically strong, one piece, electrically conductive element for applying the compliant mechanical forces to maintain intimate contact of metallized insulators when mated.

2. A connector according to claim 1, wherein said one piece hermaphroditic insulator housing has surface areas coated with said electrically conductive thin metallic coating which mate in overlapping relationship with similarly coated surfaces on a hermaphroditic connector half so that a continuity of the metallic coating is obtained and, consequently, a continuation of the shielding effect is provided.

3. A connector according to claim 1, wherein said means for applying the compliant mechanical forces to maintain intimate contact with metallized insulators when mated comprises a beam member extending forward from each of said mechanically strong, one piece, electrically conductive shield elements which contact said mated hermaphroditic connector and apply pressure thereto holding the connectors together and providing an electrical connection across the interconnection gap.

4. A connector according to claim 1, wherein said one piece insulator housing is plastic.

5. A connector according to claim 4, wherein said one piece plastic housing is molded into a predetermined shape having a predetermined cavity therein for receiving and retaining said contact.

6. A connector according to claim 1, wherein said one piece insulator housing has a tubular extension at one end thereof which has an inner opening big enough to pass said contact therethrough and an outer diameter small enough to fit the shield of said coaxial wire thereover.

7. A connector according to claim 1, wherein said electrically conductive shield element includes an extension from the same end that the tubular extension extends from the one piece insulator member, said shield element extension being longer than said tubular extension.

* * * * *